US005845665A

United States Patent [19]

Koehn

[11] Patent Number: 5,845,665

[45] Date of Patent: Dec. 8, 1998

[54] DEMOUNTABLE STRUCTURE

[76] Inventor: Ekkehard Koehn, 1177 Gympie Road, Aspley, State of Queensland, 4034, Australia

[21] Appl. No.: 767,344

[22] Filed: Dec. 16, 1996

Related U.S. Application Data

[63] Continuation-in-part of PCT/AU94/00782 Dec. 16, 1994, now abandoned.

[30] Foreign Application Priority Data

Jun. 16, 1994 [AU] Australia ..... 64768/94

[51] Int. Cl.[6] ..... A45B 11/00

[52] U.S. Cl. ..... 135/98; 135/20.1; 135/20.3; 135/21; 135/23; 135/90; 135/116

[58] Field of Search ..... 135/98, 20.1, 20.3, 135/21, 23, 90, 116

[56] References Cited

U.S. PATENT DOCUMENTS

| | | | |
|---|---|---|---|
| 321,722 | 7/1885 | Herron | 135/20.3 X |
| 3,533,423 | 10/1970 | Rowland | 135/20.3 X |
| 3,926,202 | 12/1975 | Uthemann et al. | 135/20.3 |
| 3,945,106 | 3/1976 | Mayr et al. | 135/99 X |
| 4,637,415 | 1/1987 | Dalo et al. | 135/20.3 X |
| 4,677,796 | 7/1987 | Mellott | 135/99 X |
| 4,993,445 | 2/1991 | Dubinsky . | |
| 5,259,408 | 11/1993 | Guerin | 135/90 |
| 5,499,644 | 3/1996 | Geniele | 135/21 X |

FOREIGN PATENT DOCUMENTS

| | | |
|---|---|---|
| 33730/84 | 4/1985 | Australia . |
| 334821 | 9/1989 | European Pat. Off. . |
| 387965 | 9/1990 | European Pat. Off. . |
| 466661 | 1/1992 | European Pat. Off. . |
| 2420916 | 11/1975 | Germany . |
| 2842619 | 4/1980 | Germany . |
| 3229776 | 4/1983 | Germany . |
| 3339163 | 3/1985 | Germany . |
| 3820573 | 8/1989 | Germany . |
| 82/03538 | 10/1982 | WIPO . |

*Primary Examiner*—Wynn E. Wood
*Attorney, Agent, or Firm*—Abelman, Frayne & Schwab

[57] ABSTRACT

A sun shade assembly (10) includes a shade means (11) including a flexible cover (13) attached to a plurality of support arms (14), the support arms being movable from a lowered position in which the cover is in a stowed attitude and a raised position in which the cover is in an operative shading attitude, and support means (12) having a mounting base (16) and a support structure (15) upstanding from said mounting base and extending in part above said shade means (11) for supporting said shade means offset from said mounting base, and a plurality of cables (44) connected to respective ones of the support arms (14) and disposed above the cover for maintaining the cover in the operative shading attitude.

10 Claims, 5 Drawing Sheets

DEMOUNTABLE STRUCTURE

CROSS-REFERENCE TO RELATED APPLICATIONS

This is a continuation-in-part of International Application Number PCT/AU94/00782, with an international filing date of Dec. 16, 1994, now abandoned.

BACKGROUND OF THE INVENTION

This invention relates to a demountable structure.

This invention has particular but not exclusive application to a structure for use as a sun shade and for illustrative purposes reference will be made to such application. However, it is to be understood that this invention could be used in other applications such as for temporary accommodation.

Various types of sun shades are available including umbrella shades which are particularly attractive as well as being easily collapsible and portable. Furthermore they can be aesthetically pleasing and thus are often used in home gardens and for covering commercial eating and relaxing outdoor areas.

Umbrella type shade structures are often used as semi-permanent structures having a significant span such as between four to six meters. The cloth or fabric that covers the frame of the shade structure deteriorates from the effects of rain, wind and sun accordingly, such structures are capable of being folded to minimise exposure to the elements. The presently utilised folding mechanisms are often cumbersome and difficult to operate.

A further disadvantage of currently available umbrella shades results from the centrally located support shaft. This reduces the available usable area covered by the umbrella. Accordingly, tables, chairs, bodies etc must be arranged to about the central support shaft. Furthermore because the shaded area is constantly moving between sunrise and sunset, any articles protected beneath the umbrella must be shifted if continuous sun protection is required, or the position of the shade canopy must be adjusted. This is difficult to achieve in large structures.

SUMMARY OF THE INVENTION

The present invention aims to alleviate at least one of the above disadvantages and to provide a sun shade which will be reliable and effective in use.

With the foregoing in view this invention in one aspect resides broadly in a sun shade assembly including:

shade means including a flexible cover attached to a plurality of support arms, said support arms being movable from a lowered position in which the cover is in a stowed attitude and a raised position in which the cover is in an operative shading attitude;

support means having a mounting base and a support structure upstanding from said mounting base and extending in part above said shade means for supporting said shade means offset from said mounting base; and a plurality of cables connected to respective ones of said support arms and disposed above said cover for maintaining said cover in the operative shading attitude.

Preferably, said support structure is a continuous tubular support structure and said cables extend upwardly from said support arms into said support structure where they are operatively connected to a winching cable which in turn is connected to the drum of a winch or other suitable erecting means for raising and lowering said support arms to move the shade means from its stowed attitude to its operative shading attitude. Suitably, such winch is located in an easily accessible position towards the lower end of the support structure and the winching cable passes over a series of guide rollers supported within said structure.

Preferably, the cables are maintained in an operatively divergent attitude with respect to said support arms by spreader members each pivotally connected at one end to a support arm and at the other end secured to the respective corresponding cable. Advantageously, such divergence of the cables relative to the support arms allows upward movement of the cables by the winch to cause the support arms to pivot about their inner ends by applying thereto a non-aligned force. It is also preferred that said cables be operatively connected to said spreader members respectively at positions adjacent the position at which said cables enter said support structure when said cover is in the operative shading attitude.

Preferably, said support structure is pivotally mounted to said mounting base so as to permit said shade means to at least partially orbit about said mounting base. In such form of the invention it is also preferred that said sun shade assembly include locking means for locking the support structure in a selected position relative to said mounting base. In a preferred form said locking means includes a friction brake on said support structure selectively engagable with said mounting base.

BRIEF DESCRIPTION OF THE DRAWINGS

In order that this invention may be more readily understood and put into practical effect reference will now be made to the accompanying drawings which illustrate typical embodiments of the invention and wherein.

DESCRIPTION OF THE PREFERRED EMBODIMENT

Figure 1:
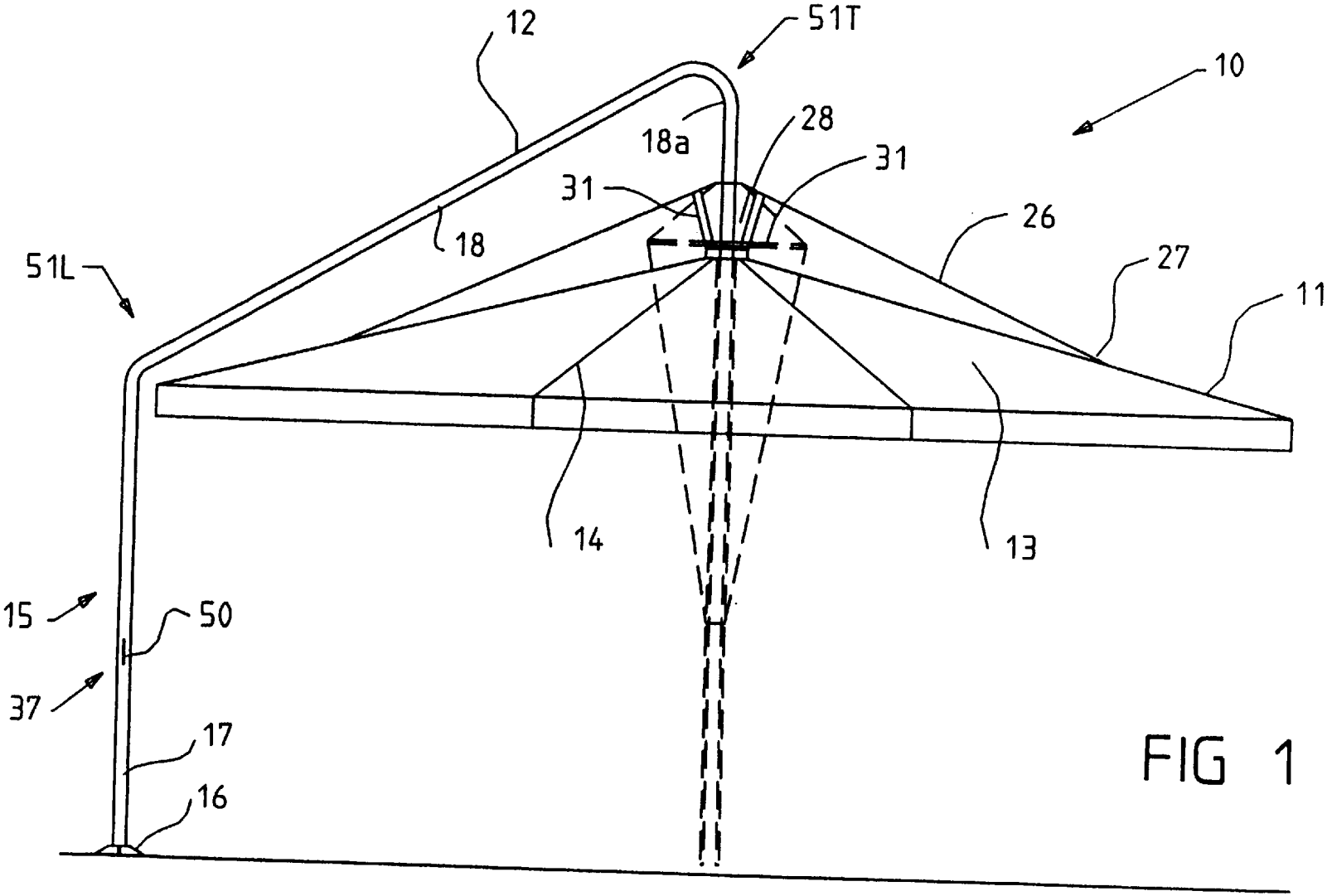
FIG. 1 is a side view of a sun shade assembly constructed in accordance with the present invention with the shade means in the erected attitude.
Figure 2:
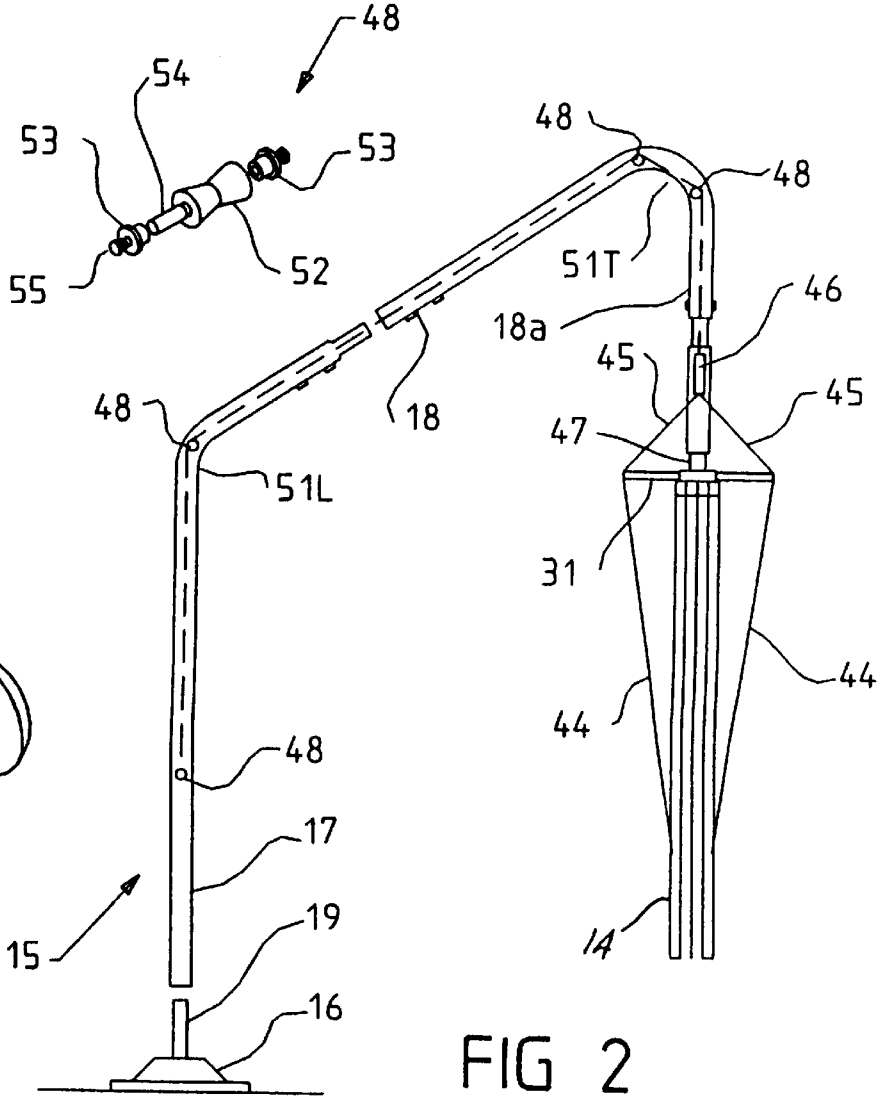
FIG. 2 is an assembly view of a sun shade assembly constructed in accordance with the present invention with the shade means in the lowered stowed attitude.
Figure 3:
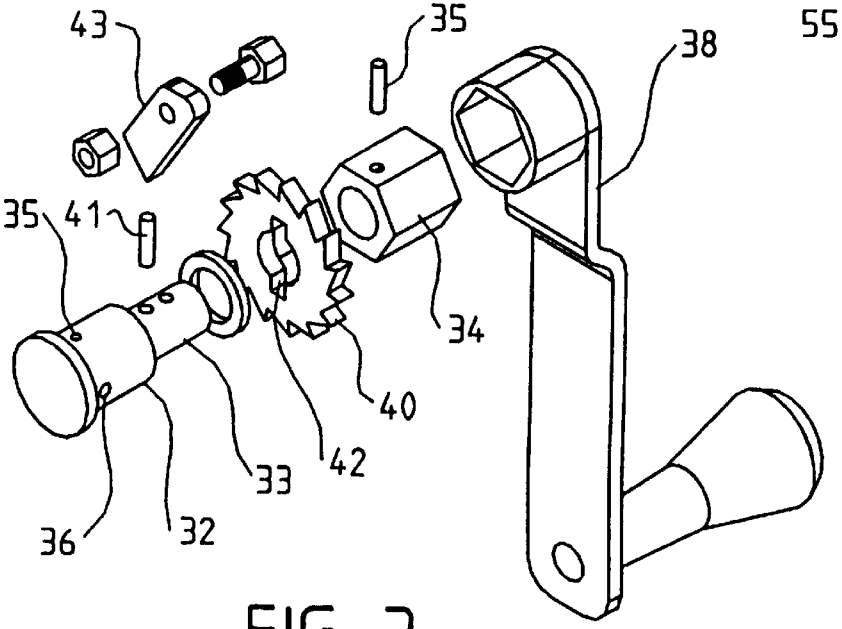
FIG. 3 is an exploded view of the winch of the sun shade assembly illustrated in FIG. 1.

The sun shade assembly 10 illustrated in FIGS. 1 to 5 comprises shade means 11 supported from above by support means 12 which is displaced laterally from the shade means 11 so as not to intrude upon the region directly below-the shade means, The shade means 11 is capable of movement between a stowed or folded position, illustrated in a dashed outline, and an operative shading position, as illustrated in FIG. 1. The shade means in this embodiment includes a fabric cover 13 which is supported by a plurality of outwardly divergent support arms 14 which are pivotally connected at their inner ends to a central support member 47 mounted to the upper end of the support means 12.

The support means 12 in this embodiment includes a tubular post 15 comprising a mounting base 16, an upstanding intermediate portion 17 rotatably mounted on the base 16, and an upper arm portion 18 which is connected to, and extends both upwardly and outwardly from an end of the intermediate portion 17. The arm portion 18 includes a downturned end portion 18a to which the support member 47 is secured to which in turn the shade means is connected.

The mounting base 16 is adapted for secure attachment to a mounting surface such as concrete by bolts and includes an upstanding bar or spigot 19 which is located within the lower end of portion 17.

The intermediate portion 17 has a circular cross-section so that it may rotate freely relative to the mounting base 16. This enables the shade means 11 to orbit about the mounting base such that the area to be covered or shaded by the shade means may be selectively varied.

Figure 5:
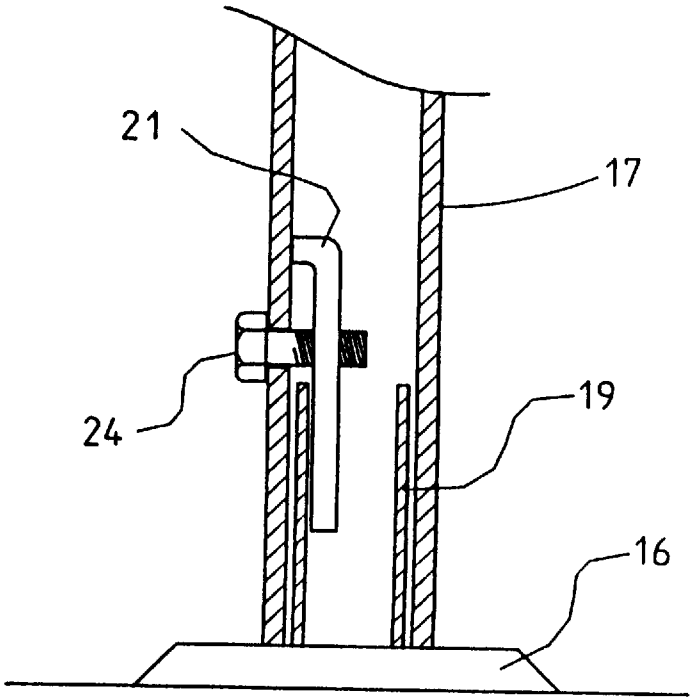
FIG. 5 is an exploded view of a section through the lower portion of the support structure of FIG. 1 showing the clamping member clamping the support structure to the spigot in accordance with the present invention.
Figure 4:
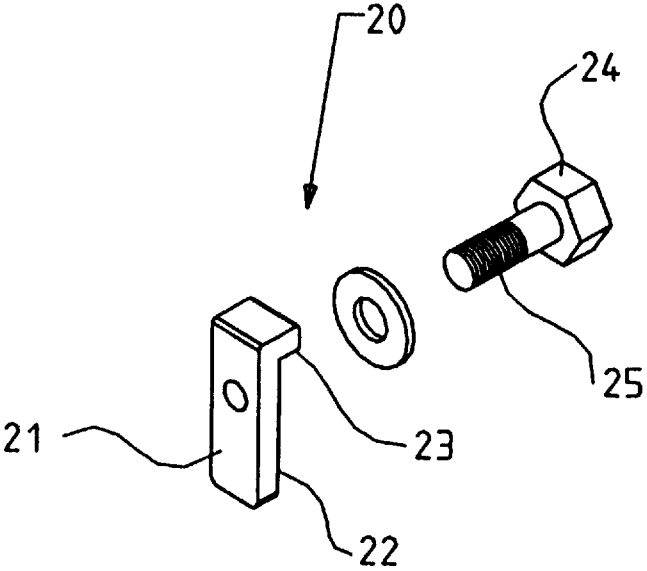
FIG. 4 is a pictorial representation of a clamping member for preventing rotation of the support structure of the assembly of FIG. 1.
Figure 6:
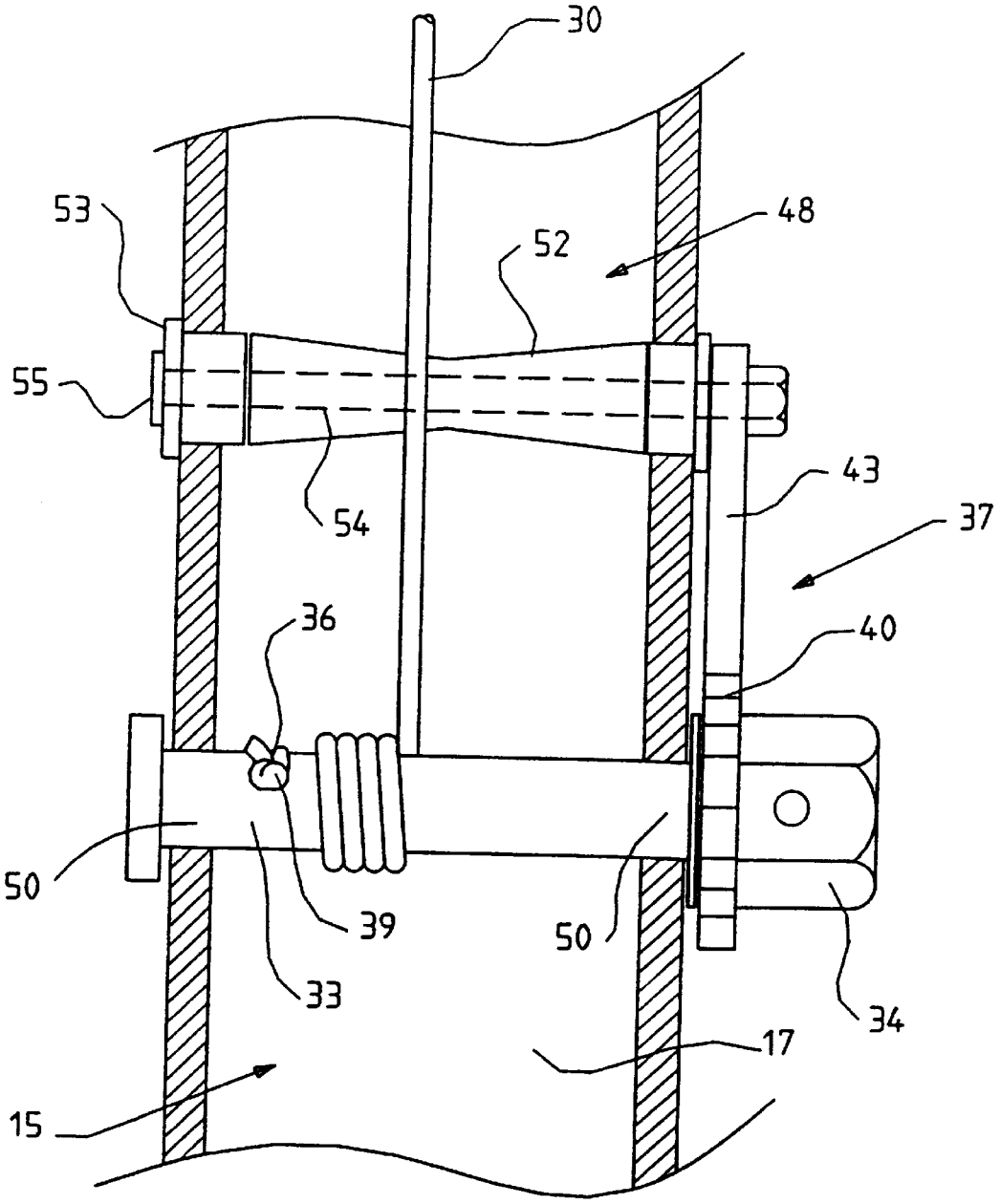
FIG. 6 is an expanded view of the winch assembly.

In order to prevent unwanted rotation of the shade means 11, the sun shade assembly 10 is provided with locking means 20 as illustrated in FIGS. 4 and 5, which is selectively operable to clamp the intermediate portion 17 to the spigot 19, which in this embodiment is a tubular member which nests neatly within the member 17. The locking means 20 includes an inverted "L" shaped clamping member 21 having a lower end portion 22 and a stepped end portion 23. The lower end portion 22 frictionally engages the internal wall of the spigot 19. Engagement and disengagement of the clamping member 21 with the spigot is effected by tightening a bolt 24 having threaded stem 25 which extends through an aperture formed in the wall of the intermediate portion 17 to engage with a threaded aperture formed in the clamping member 21.

Each support arm 14 is associated with a spreader bar 31 pivotally mounted to support member 47 at its inner end, and fixed to its respective cable 44 at its outer end, the cable being connected at its outer end to its respective support arm and at its inner end to winch cable 30 which terminates in the end portion 18*a* of the support means and operatively connects the cables 44 to the winch assembly 37. The spreader members or bars are operative to maintain the cables 44 at an angle to the arms 14 so that winching of the cable 30 causes the support arms to pivot upwardly to a position adjacent the exit box 46 such that maximum leverage is achieved as the cover 13 moves to its operative shading position and minimum leverage is provided at minimum load when the cover 13 is folded. The maximum outward pivoting of the arms 14 is determined by the circumference of the fabric cover 13 and is limited to the operative position illustrated in FIG. 1.

In order to maintain clearance between the cable 30 and the inner face of the post 15, the cable passes over four roller assemblies 48. These are arranged along the neutral axis at opposite sides of the top bend 51*t* and at the centre of the lower bend 51*l*. The fourth roller is located adjacent the winch assembly 37 so as to provide a cable lead-on guide for the winch assembly 37.

Each roller assembly 48 includes a roller member 52 tapering inwardly to a necked central portion which ensures that the cable 30 is biased to the middle of the roller member. The roller assembly further includes an axle 54 rotatably supported by end bushes 53 arranged at each end of the roller member 52 and adapted to be retained within apertures in the opposed walls of the post 15 by screws 55 extending into the axle 54.

The winch assembly 37 is mounted via opposed apertures 50 provided in the intermediate member 17 and comprises a hub assembly 32 mounted on a winch shaft 33 passing through apertures 50. The opposite end of the winch shaft includes a hexagonal drive nut 34 maintained in place by pin 35, so that the drive nut can rotate the shaft. The winch shaft extends into the bore of the intermediate member 17 and the cable 30 is connected to the hub assembly 32 via an aperture 39 in the cylindrical face thereof and held in position by a grub screw 36.

The winch assembly 37 further includes a releasable anti-reverse mechanism to selectively prevent unwinding of the winch shaft. The mechanism includes a ratchet wheel 40 slidably mounted to the shaft 33 between the nut 34 and the hub assembly 32 so as to be able to rotate the shaft, via a pin 41 extending through the shaft and engaging in a slot 42 formed in the ratchet wheel 40. The anti reverse mechanism also includes a pawl 43 located on the shaft of the adjacent guide roller for operative engagement with the ratchet wheel to prevent reverse rotation of the shaft. The pawl may be released upon pressure being removed therefrom by being flipped over to present its opposite side to the ratchet wheel.

The winch assembly also includes a drive handle 38 having a hexagonal drive socket 60 for easy slide-on attachment to the drive nut 34 for rotating the winch shaft 33. Suitably the cable 30 is so dimensioned that a single layer rolled around the shaft 33 provides sufficient length for movement of the cover 13 between the folded and unfolded positions. This coupled with the short cable lead from the adjacent roller 48 enables overrides and jamming to be substantially eliminated.

In use, the shade means 11 is erected by rotating winch handle 38 in anti-clockwise direction so that cable 30 is wound onto winch shaft 33 and hub 32 thereby pulling the shade means 11 upwardly to the erected position. When fully erected the pawl 43 is moved so as to engage the ratchet wheel 40 thereby holding the cable tight and maintaining the shade means in the erected position.

The shade means 11 can be moved so as to shade a desired region by rotating support means 12 about spigot 19. Upon rotation to a desired position support means 12 can be locked to spigot 19 by tightening bolt 24 so as to pull clamp 21 against an inner face of spigot 19 and a portion of the inner face of intermediate member 17 against the spigot. The hexagonal drive nut 34 is the same dimension as the bolt head 24 so that the handle 38 may be used for both operations.

The folded fabric cover 13 may be stowed in an out of the way location by pivoting the post about its mounting base. When shading is required the fabric cover may be winched upwardly into position and swung about the base mounting 16 to its operative position where it may be locked it desired. Thereafter as the sun changes position, the covering may be moved to achieve a more effective shade, if possible.

Figure 7:
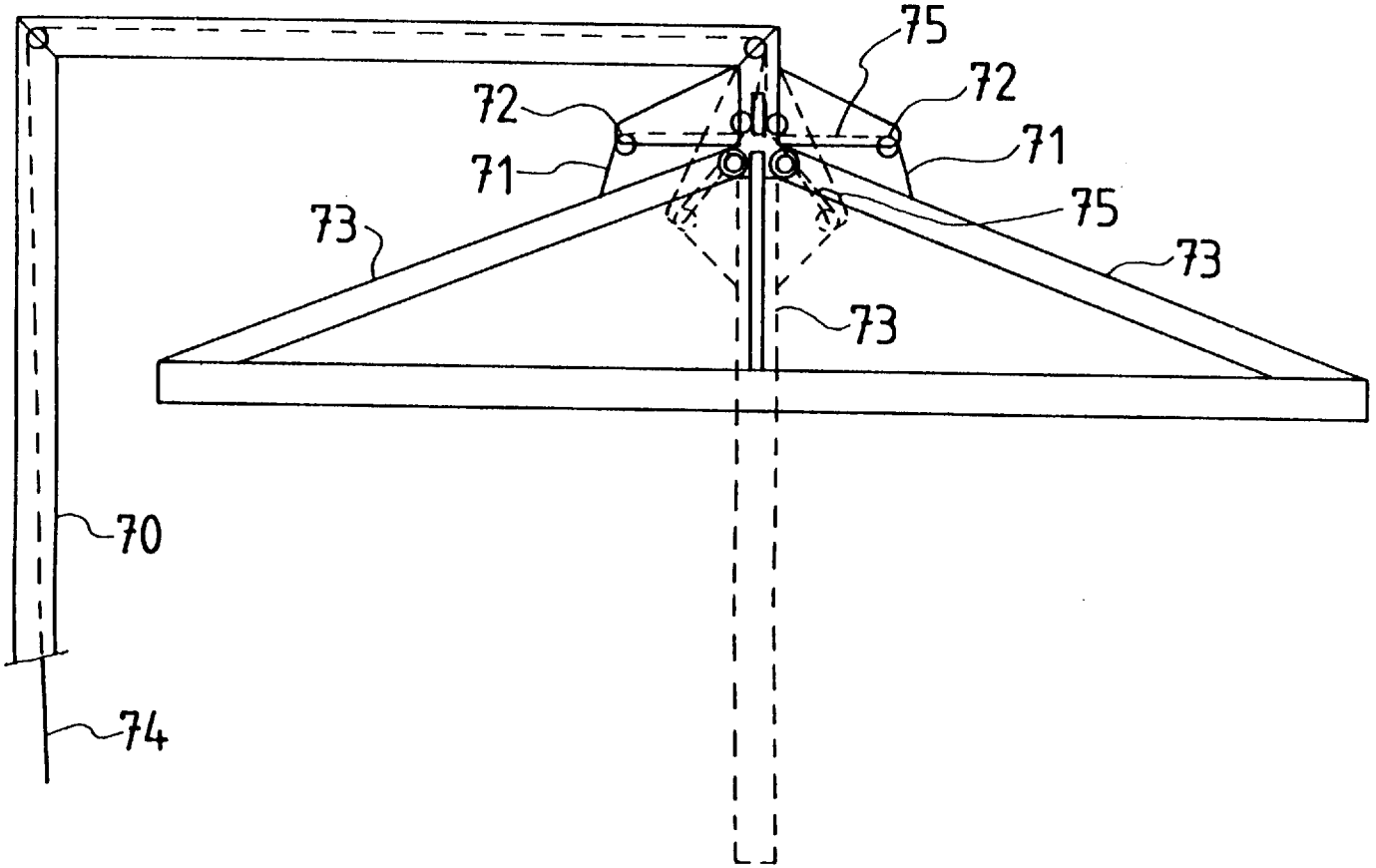
FIG. 7 illustrates a further embodiment of the invention.

In the embodiment illustrated in FIG. 7, the post 70 has welded right angle joints and the sub-stays 71 extend directly from outwardly positioned blocks 72 to the support arms 73 providing the desired stay angle for initial lifting from the folded position. The sub-stays 71 connect to a single winch stay 74-for actuation thereby. The spreader bars 75 have an analogous function to the spreader bars 31 in the embodiment shown in FIG. 1, and keep the sub-stays 71 at an angle to the support arms 73.

It will of course be realised that while the above has been given by way of illustrative example of this invention, all such and other modifications and variations thereto as would be apparent to persons skilled in the art are deemed to fall within the broad scope and ambit of this invention as defined in the appended claims.

I claim:

1. A sun shade assembly including:

shade means including a flexible cover attached to a plurality of support arms, said support arms being movable from a lowered position in which the cover is in a stowed attitude and a raised position in which the cover is in an operative shading attitude;

support means having a mounting base and a support structure upstanding from said mounting base and extending in part above said shade means for supporting said shade means offset from said mounting base;

a plurality of cables connected to respective ones of said support arms and disposed above said cover for maintaining said cover in the operative shading attitude, said cables extending upwardly from said support arms into said support structure; and spreader members operatively connected to said support arms for maintaining an operative divergence between the respective cables and the support arms such that outer ends of said spreader members supporting said respective cables are in a first position when the cover is in the stowed attitude and are in a second position when the cover is in the operative shading attitude said second position being upward from said first position.

2. A sun shade assembly as claimed in claim 1, wherein said cables are operatively connected to said spreader members respectively at positions adjacent the position at which said cables enter said support structure when said cover is in the operative shading attitude.

3. A sun shade assembly as claimed in claim 1, further including erecting means for moving said shade means to said operative shading attitude.

4. A sun shade assembly as claimed in claim 3, wherein said erecting means includes a winch assembly mounted on a lower portion of said support structure and said cables are operatively connected to said winch assembly for retraction into said support structure.

5. A sun shade assembly as claimed in claim 4, wherein said cables are operatively connected to said winch assembly by a further cable which passes over guide rollers supported within said support structure.

6. A sun shade assembly as claimed in claim 1, wherein said support structure is pivotally mounted to said mounting base.

7. A sun shade assembly as claimed in claim 6, wherein pivoting of said support structure permits said shade means to at least partially orbit about said mounting base.

8. A sun shade assembly as claimed in claim 7, including locking means for locking said support structure in a selected position relative to said mounting base.

9. A sun shade assembly as claimed in claim 8, wherein said locking means includes a friction brake on said support structure selectively engagable with said mounting base.

10. A sun shade assembly as claimed in claim 8, wherein said support structure is a continuous tube in form pivotally supported for rotation about a substantially vertical axis on said mounting base.

* * * * *